US005127743A

United States Patent [19]

Miller et al.

[11] Patent Number: 5,127,743

[45] Date of Patent: Jul. 7, 1992

[54] METHOD OF MANUFACTURING A PACKAGE HAVING A BUILT-IN PROMOTIONAL PIECE

[75] Inventors: Robert F. Miller, Atlanta; Ronald E. Carroll, Flowery Branch, both of Ga.

[73] Assignee: Dittler Brothers, Inc., Atlanta, Ga.

[21] Appl. No.: 686,318

[22] Filed: Apr. 16, 1991

Related U.S. Application Data

[63] Continuation of Ser. No. 483,106, Feb. 22, 1990, abandoned, which is a continuation-in-part of Ser. No. 270,418, Nov. 7, 1988, abandoned, which is a continuation-in-part of Ser. No. 118,900, Nov. 10, 1987, abandoned.

[51] Int. Cl.[5] ..... B65D 30/08

[52] U.S. Cl. ..... 383/109; 383/106; 383/111; 283/105; 283/109

[58] Field of Search ..... 383/106, 109, 111; 283/56, 94, 105, 109, 903; 206/232, 459; 53/415

[56] References Cited

U.S. PATENT DOCUMENTS

| | | | |
|---|---|---|---|
| 2,260,064 | 10/1941 | Stokes . | |
| 2,867,372 | 1/1959 | Fox | 206/610 |
| 3,153,868 | 10/1964 | Jones | 40/299 |
| 3,413,899 | 12/1968 | Timms | 493/220 |
| 3,524,782 | 8/1970 | Buske | 156/248 |
| 3,998,135 | 12/1976 | Sargent . | |
| 4,246,709 | 1/1981 | Selleslags | 40/310 |
| 4,268,344 | 5/1981 | Jones | 156/383 |
| 4,307,900 | 12/1981 | Krautsack | 283/56 |
| 4,308,679 | 1/1982 | Ray, III et al. | 40/312 |
| 4,324,823 | 4/1982 | Ray, III et al. | 40/312 |
| 4,345,393 | 8/1982 | Price et al. | 40/312 |

OTHER PUBLICATIONS

A bag for Wonder® light wheat bread.

A bag for Yum Yum cheese sticks.

A bag for McCormicks Mcbig® chocolate snaps (including a coupon having an expiration date of Oct. 31, 1979).

*Primary Examiner*—Stephen P. Garbe

*Assistant Examiner*—Nova Stucker

*Attorney, Agent, or Firm*—Kilpatrick & Cody

[57] ABSTRACT

A method of producing a package having a built-in promotional piece by an extrusion lamination process, having the steps of providing a first web of first packaging wall material, placing a promotional piece on the first wall material, directing a first quantity of hot liquid plastic over the first wall material adjacent the piece, directing a second quantity of hot liquid plastic over the promotional piece to form a composite, the second quantity of liquid plastic being less than the first quantity of liquid plastic, attaching second wall material over the composite using an extrusion lamination process to form final packaging wall material and forming the final packaging wall material into a package.

8 Claims, 3 Drawing Sheets

METHOD OF MANUFACTURING A PACKAGE HAVING A BUILT-IN PROMOTIONAL PIECE

CROSS-REFERENCE TO RELATED APPLICATION

This application is a continuation of copending application Ser. No. 07/483,106, filed Feb. 22, 1990, abandoned which is a continuation-in-part of application Ser. No. 07/270,418, filed Nov. 7, 1988, now abandoned, which is a continuation-in-part of application Ser. No. 07/118,900, filed Nov. 10, 1987, now abandoned, each of which applications is incorporated herein in its entirety by this reference.

BACKGROUND OF THE INVENTION

The present invention relates to the retail promotions industry, and more particularly to a method of manufacturing a package having a promotional piece or other item built into its walls.

It is a common promotional strategy to distribute game cards, coupons, or other promotional pieces with packaged products in an attempt to increase sales. Game cards in particular have historically been a successful means for obtaining quick consumer reaction to a product.

In the past, various schemes have been devised for distributing promotional pieces with the product at the point of purchase. A fairly simple yet widely used method involves the printing of the information directly onto the packaging itself. This has proven to be inefficient, however, because most packaging materials are not conducive to having printing placed upon them other than that relating to the standard label. In the particular case relating to games, it is important that certain printing be hidden from view until after the sale of the product and opening of the packaging. This requires the writing to be placed on the inside portion of the package which, being designed for providing and maintaining the proper environment around the product, is in most instances not well suited for holding print. In the case of plastic packages, such as potato chip bags, such printing is undesirable. Also, the amount of printing is limited to the size of the space available on the label. Also, the high cost involved in varying the printing on each individual package limits the ability to use a large number of different types of messages.

A second method for distributing promotional pieces has been to glue or otherwise affix the game piece to the outside of the package. For instance, a first sticker may be placed upon the outer surface of the package and have information printed on its exposed surface. A second, more readily peelable sticker is then placed over the printing to be removed after sale. Related methods involve printing the information either on the package directly and covering the printing with a sticker, or printing the information onto the bottom of an easily peelable sticker and placing the sticker on the package. Quite often, however, game pieces such as these are subjected to consumer tampering in the stores. For example, stickers on the outside of packages are easily peeled or removed. This renders the promotion useless, and has the corresponding effect of decreasing sales of the product itself. Another problem with such "sticker" type game pieces is that the application of the pieces to the package slows in-plant production. Still another problem is that the stickers are typically capable of hiding or carrying only a small amount of printing.

Another means for distributing game pieces involves overwrapping the piece in cellophane and mechanically inserting the piece into the package. While this method allows pieces of relatively large size to be employed, it is costly and typically results in slowing down in-plant production.

There have been many attempts at placing promotional pieces within package walls. However, they all have involved placing the piece within a pouch in the wall, which results in movement of the piece and loss in wall strength, or simply giving the piece to a wall surface. In both cases, the packaging material could not be effectively placed into rolls due to displacement caused by the presence of the pieces between the roll layers. Also, the pieces were always placed onto the final product during its manufacturing stage, which required modification of the package assembly process. Also, the package assembly process is slowed down by the step of inserting of the piece.

Therefore, there exists a need, for a package having a built-in promotional piece which is simple in design and cost effective.

There also exists a need for a package having a promotion piece in which the piece is not susceptible to tampering and which can only be accessed after the package is sold and destroyed.

There also exists a need for a package having a promotional piece which prevents contamination of the piece by the product as well as contamination of the product by the piece.

There also exists a need for a method of producing such a package quickly and efficiently.

There exists a further need for a method of producing such a package which allows the piece to be placed in rolls of wall material prior to manufacturing the final package, and which requires no modification of the package assembly process.

SUMMARY OF THE INVENTION

The present invention relates to a package having a promotional piece built into its wall, as well as a method for its manufacture.

Most packages currently in use today, and particularly those used in sales of food items, are comprised of two layers, at least one of which is usually a plastic film, laminated together to form a single package wall. An inner layer typically is used to maintain the environment inside the package in a stable condition. The outer layer typically contains the labeling for the package.

According to the present invention, a promotional piece, such as a paper game card, coupon, or other form of advertisement is located between two layers of the package so that it is actually built into the package wall. Alternatively, the piece may be located between a package wall and an attaching strip laminated to the package wall. In the latter embodiment, the strip layer may be attached to either the interior surface or the exterior surface of the package wall, which may be of single or multiple layers. In both embodiments, the lamination completely surrounding the piece maintains the position of the promotional piece within the package and prevents tampering and contamination. A window may be provided in the outermost layer so that the piece may be seen without destruction of the package. This may be accomplished by leaving the area of the outer layer contacting the piece transparent.

A novel method of producing the packages is also provided by the present invention. A promotional piece is placed atop first wall material from a first web. A first quantity of hot liquid polyethylene is directed onto the exposed first wall material adjacent the piece, preferably from one or more adjustable dieheads. A second quantity of hot liquid polyethylene, less than the first quantity, is directed over the piece to form a first wall material-piece-liquid polyethylene composite. Thereafter, a second wall material is attached over the composite using an otherwise standard extrusion method of lamination to form final packaging wall material.

The present invention has several advantages over the current means of distributing promotional pieces. First, the invention eliminates the need to "overwrap" the piece and thereafter insert it into the package. In the package of the present invention, the piece is protected from contamination of and by material inside the package by being located between the two layers of material. Also, the present invention allows the manufacturer of the product to accept packaging with the pieces already built into the package wall, thereby eliminating the need for an insertion step. This results in reduced manufacturing costs and fewer production line problems than with current methods of in-packing. Especially important is the fact that production is never slowed down. It has been recognized that the piece may adhere to the layers, and removal may be difficult. It has been found that this problem can be overcome by applying a transparent releasing agent to the outer surface of the piece prior to the extrusion lamination process.

Secondly, the present invention greatly reduces or eliminates the tampering of packages containing game pieces. To gain access to the piece, the package must be opened and destroyed. Such need to destroy the package also results in increased consumption of the packaged product as consumers search for the piece. Also, because the printing of the piece is performed separately from that of the package, a greater variety of messages may be provided. This enables each individual package to carry a potentially different game piece.

Another important advantage of the present invention is that security involving game pieces in the manufacturing plant is greatly enhanced by eliminating access to loose pieces. Rather, the pieces typically enter the plant already built into the package walls, and are relatively inaccessible when the wall material is held in pre-production rolls. Also, security is further increased by eliminating the need to overwrap the game piece, and by eliminating the subsequent need to load the overwrapped pieces into inserting machines.

Additionally, the final packaging wall material may be effectively placed into a roll with minimal or no displacement caused by the presence of the pieces between the roll layers. Also, the final material can be pre-manufactured and stored without risk of lost or stolen pieces and there will be no need to modify the process of assembling a final package from the rolled material.

Therefore, it is an object of the present invention to provide a package having a built-in promotional piece which is simple in design and cost effective.

It is also an object of the present invention to provide a package having a built-in promotional game piece in which the piece is not susceptible to tampering and which can only be accessed after the package is sold and destroyed.

It is another object of the present invention to provide a package having a built-in promotional piece which prevents contamination to the piece by the product.

It is another object of the present invention to provide a method of producing such a package quickly and efficiently.

These and other objects and advantages of the present invention can be seen with reference to the following description and related drawings.

DETAILED DESCRIPTION OF THE DRAWINGS

Figure 1:
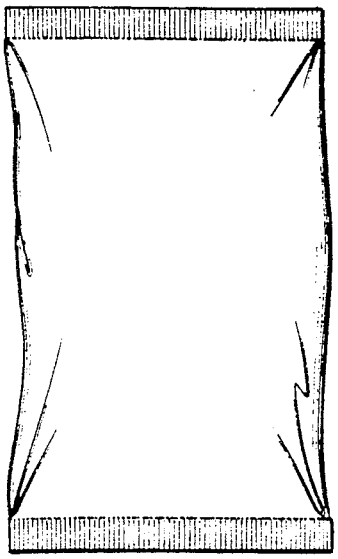
FIG. 1 is a rear elevational view of one embodiment of a package of the present invention.

The preferred embodiment is now described with reference to the drawings. The present invention relates to a package having a promotional piece built into its wall, as well as to a method for its manufacture. This embodiment relates to the use of the invention as a bag, although any other form of packaging may be used. Before assembly, as shown in FIG. 1, the package is comprised of a rectangular piece of material forming a package wall. The package wall 8 has a top edge 11, a bottom edge 13, a first side edge 15, and a second side edge 17. To form a bag, the first side edge 15 and the second side edge 17 are brought together and sealed. To complete the enclosure, the two halves of the now doubled over top edge 11 are sealed, as are the two halves of the doubled over bottom edge 13. Located in the wall 8 is a promotional piece 24.

Figure 2:
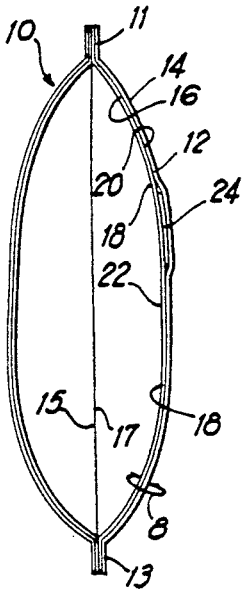
FIG. 2 is a cross-sectional view of a package of the present invention with the width being exaggerated for clarity.

FIG. 2 shows a cross-sectional view of a package 10 of the present invention having a promotional piece 24 built into its wall 8. A first layer of material, is provided to form an outer package wall layer 12. The outer layer 12 has an exterior surface 14 and an interior surface 16. The outer layer 12 may be made of any suitable material, although for proper lamination discussed in greater detail below, it is preferably that the outer layer 12 be made of a plastic film. The exterior surface 14 of the outer layer 12 may contain printing for labeling or other purposes. A second layer of material is provided to form an inner package layer 18, which has a contacting surface 20 and an exposed surface 22. The inner layer 18 may be made of any suitable material, although it should preferably be of a type which can be effectively laminated to the outer layer 12. Plastic film and metalized films are examples of such material. The two layers 12, 18 are laminated by extrusion lamination in such a manner that the contact surface 20 of the inner layer 18 contacts the interior surface 16 of the outer layer 12.

A promotional piece 24 is located between the contact surface 20 of the inner layer 18 and the interior surface 16 of the outer layer 12. Upon extrusion lamination, the two layers 12, 18 surround the piece 24 and act to hold it firmly in place. The piece 24 is therefore built into the package wall 8. The piece 24 may be a game card, coupon or advertisement made of folded paper, or it may be any other item capable of being placed between and held in position by the two attached layers 12, 18. Means for easily removing the piece 24 from between the layers 12, 18 may be provided. For instance, a pull tab and perforation combination 19, as seen in FIG. 1, may be employed. It is also preferred that the inner layer 18 be transparent so that the promotional piece 24 is visible to one viewing the interior portion of the package 10. Also, if the product sold in the package 10 is greasy or is susceptible to becoming stale, the inner layer 18 material can be of such type as to provide protection to the piece 24 as well as to maintain a proper environment inside the package 10. Also, the product is protected from the piece 24. Upon the sealing of the edges 11, 13, 15, 17, the piece becomes enclosed in the package 10 and is protected from contamination and is less susceptible to tampering. A release coating may be provided on the outer surfaces of the piece 24 to better allow the separation of the piece 24 from the laminated layers 12, 18. For example, a transparent silicone-based agent may be sprayed onto or otherwise applied to the piece 24 before it is placed between the layers 12, 18.

Figure 3:
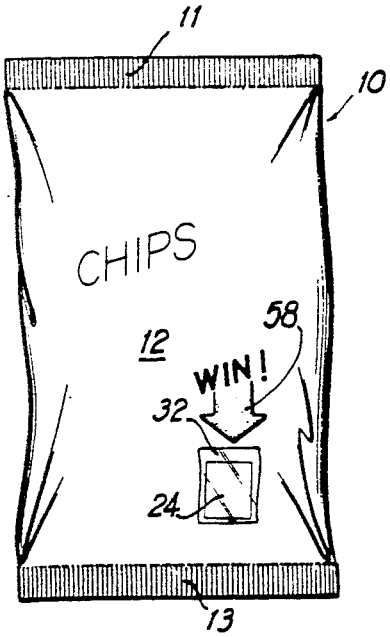
FIG. 3 is a front elevational view of a package of the present invention having a window.

A window 32, as shown in FIG. 3, may be provided to make the piece 24 visible while inside the sealed package 10. This may be accomplished by making the area of the outer package layer 12 which contacts the piece 24 transparent. This will allow the piece 24 to have its printing observed by consumers before sale of the product and without destruction of the package 10 and enables printing to be provided on the package 10 in a manner juxtaposed with the firmly maintained location of the piece 24, as shown in FIG. 3.

It can be seen, therefore, that the present embodiment utilizes already existing elements of a two-layered package 10, i.e. the inner layer 18 and the outer layer 12, and makes use of them in a unique manner. However, the present invention may also be used with packages which do not utilize two layers, as shown in the following embodiments.

Figure 4:
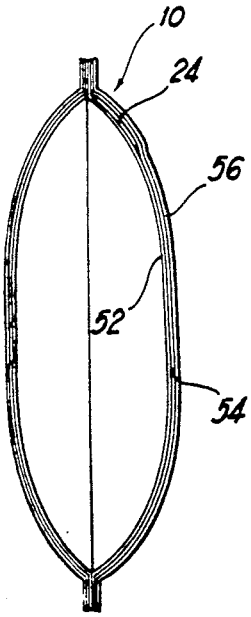
FIG. 4 is a cross-sectional view of a package of the present invention having more than two laminated layers with the width being exaggerated for clarity.
Figure 5:
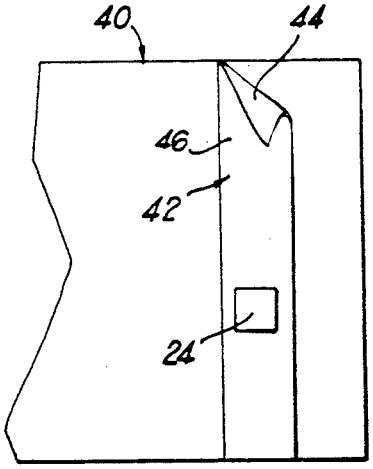
FIG. 5 is an elevational view of a package of the present invention having the promotional piece held in place by an attaching strip.

The package 10 of the present invention may also have more than two laminated layers, as shown in FIG. 4. A first, innermost layer 52 is laminated to a second, middle, layer 54, which is laminated to a third, outmost layer 56. A promotional piece 24 may be placed between the first layer 52 and second layer 54 and held in place by the lamination surrounding the piece 24. Alternatively, the piece 24 may be placed between the second layer 54 and the third layer 56. Each layer of material between the outside portion of the package 10 and the promotional piece 24 may have a transparent portion corresponding to the location of the piece 24 so that the piece 24 is visible from outside the package 10. Also, each layer of material between the inner portion of the package 10 and the promotional piece 24 may have a transparent portion corresponding to the location of the piece so that the piece 24 is visible from inside the package 10. FIG. 5 shows a package wall 40 which may be of single or multiple layers and which may be used to form a package. An attachment strip 42 is provided which has an inner surface 44 and an outer surface 46. The strip 42 has a promotional piece 24 attached to its inner surface 44. The attachment strip 42 can be then attached to the package wall 40, by extrusion lamination, thereby sealing and holding the piece 24 between the wall 40 and the strip 42. The strip 42 containing the piece 24 may be applied to either the interior surface of the package wall 40, in which case the promotional piece will be inside the package when sealed, or the exterior surface of the package wall 40, in which case the piece 24 will be plainly visible to prospective buyers. In both cases, the piece 24 will be protected from contamination and tampering with minimal change to the package. The width of the strip 42 can depend upon the width of the promotional piece 24, and therefore material costs are saved.

Figure 6:
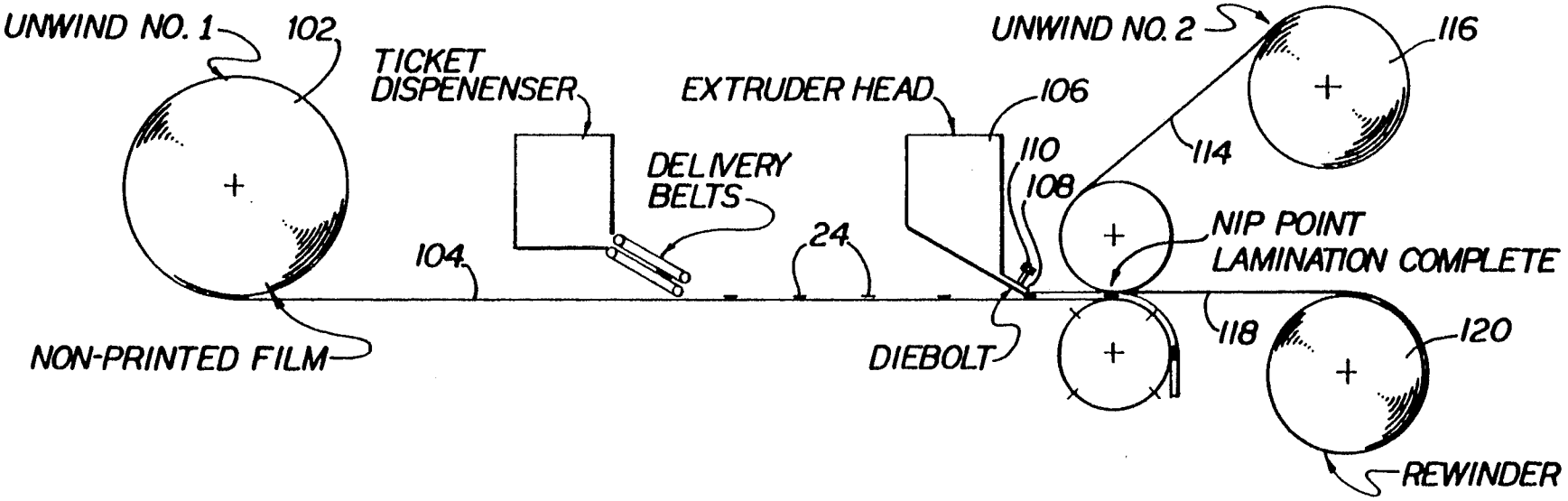
FIG. 6 is a schematic illustration of the method of producing a package according to the present invention.

The package of the present invention may be produced according to a modified extrusion method. As illustrated schematically in FIG. 6, a plurality of pieces 24 are placed atop one side of a first web 102 of first wall material 104, such as metalized film. The pieces 24 are spaced apart as desired. The piece 24 may be held in place on the first web 102 by means of static electricity.

Figure 7:
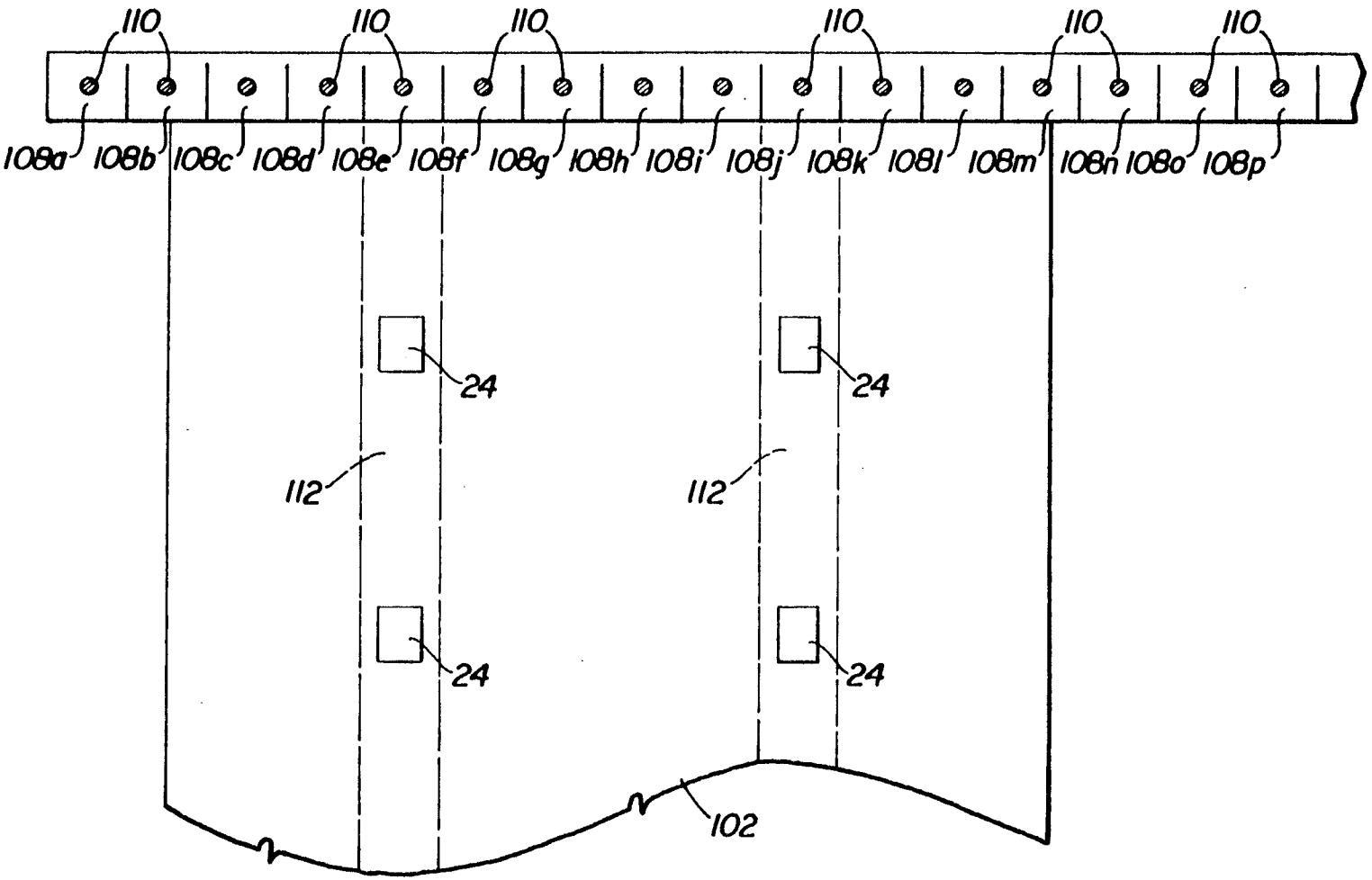
FIG. 7 is a schematic illustration of the step of applying liquid plastic according to the present invention.

Liquid polyethylene or a similarly usable molten plastic is heated to about 600° F. in an extruder head 106 and provided over the exposed first wall material 104 and the pieces 24 by means of a plurality of adjustable dieheads 108 *a–p*, positioned laterally across the web 102, as seen in FIG. 7. Each diehead 108 *a–p* directs a band of approximately one to two inches of liquid polyethylene onto the web 102 and piece 24. The amount of liquid polyethylene directed by any individual diehead 108 *a–p* can be controlled by adjusting the diehead adjustment bolts 110. It has been found that by adjusting the amount of liquid polyethylene emitted from specific dieheads 108 *a–p*, a channel 112 can be formed on the first material 104 in which the piece 24 may rest. For example, as shown in FIG. 7, first dieheads 108 *a–d*, *f–h*, and *j–p*, which deliver liquid over the first material 104 but not the piece 24, may be adjusted to deliver a first amount of liquid polyethylene. Second dieheads 108*e* and 108*i*, which deliver liquid over the pieces 24, may be adjusted to deliver a lesser amount of liquid polyethylene. In this way, the piece 24 will sit within the channel 112, and will therefore not appear above the level of the liquid polyethylene delivered by the first dieheads 108 *a–d*, *f–h* and *j–p* on the web 102. Rather, a level surface will be acquired. Thereafter, a second wall material 114, such as a printed film, may be provided atop the composite formed by the first material 104, piece 24 and liquid polyethylene according to known extrusion methods to form a final packaging wall material 118, which incorporates the two layers 12, 18 shown in FIG. 1.

The final packaging wall material can be placed into a roll using a standard rewinder 120 without any unevenness in the roll due to the presence of the pieces 24. Also, the final product will provide the appearance of a unitary construction, rather than merely a piece 24 in a pouch. Furthermore, the roll of final packaging material may be stored until assembled into a package using known methods.

While the invention has been described in detail with particular reference to the preferred embodiment thereof, it will be understood that variations and modifications can be effected within the spirit and scope of the invention as previously described and as defined in the claims.

What is claimed is:

1. A sealable package having an interior and a substantially unitary wall, comprising:
   a. an outer ply comprising:
      i. an exterior surface;
      ii. an interior surface communicating with the exterior surface and comprising:
         A. a first portion; and
         B. a second portion;
      iii. a first side edge; and
      iv. a second side edge for sealing to the first side edge;
   b. an inner ply comprising:
      i. an exposed surface; and
      ii. a contacting surface communicating with the exposed surface and comprising:
         A. a first portion bonded to the first portion of the interior surface to form the substantially unitary wall; and
         B. a second portion not bonded to the interior surface;
   c. a removable piece positioned between but not adhered in any manner to the second portions of the contacting and interior surfaces and having a periphery entirely surrounded by and closely adjacent to the bonded first portions of the contacting and interior surface, for preventing movement of the piece relative to the second portions of the contacting and interior surfaces; and
   d. a non-adhesive coating, applied to the piece prior to positioning between the second portions of the contacting and interior surfaces, for preventing the piece from bonding to the second portions of the contacting and interior surfaces and thereby facilitating removal of the piece from the package.

2. A package according to claim 1 in which the inner ply comprises:
   a. a first side edge; and
   b. a second side edge for sealing to the first side edge.

3. A package according to claim 1 in which the inner ply is of smaller size than the outer ply.

4. A sealable package having an interior and a substantially unitary wall, comprising:
   a. an outer ply comprising:
      i. an exterior surface having a substantially transparent part;
      ii. an interior surface comprising:
         A. a first portion; and
         B. a second, substantially transparent potion communicating with the substantially transparent part of the exterior surface for permitting viewing through the outer ply;
      iii. a top edge comprising:
         A. a first top edge portion; and
         B. a second top edge portion sealed to the first top edge portion;
      iv. a bottom edge comprising:
         A. a first bottom edge portion; and
         B. a second bottom edge portion sealed to the first bottom edge portion;
      v. a first side edge abutting the top and bottom edges; and
      vi. a second side edge abutting the top and bottom edge and sealed to the first side edge;
   b. an inner ply comprising:
      i. an exposed surface; and
      ii. a contacting surface communicating with the exposed surface and comprising:
         A. a first portion bonded to the first portion of the interior surface to form the substantially unitary wall; and
         B. a second portion not bonded to the interior surface;
   c. a removable piece positioned between but not adhered in any manner to the second portions of the contacting and interior surfaces and having a periphery surrounded by and closely adjacent to the bonded first portions of the contacting and interior surfaces, for permitting viewing of the piece through the outer ply and preventing movement of the piece relative to the second portions of the contacting and interior surfaces; and
   d. a non-adhesive, silicone-based coating, applied to the piece prior to positioning between the second portions of the contacting and interior surfaces, for preventing the piece from bonding to the second portions of the contacting and interior surfaces and thereby facilitating removal of the piece from the package.

5. A package according to claim 4 in which the inner ply is of smaller size than the outer ply.

6. A sealable package having an interior into which snack food is placed and a substantially unitary wall, comprising:
   a. an outer ply comprising a plastic film having:
      i. an exterior surface containing printing thereon and having a substantially transparent part;
      ii. an interior surface comprising:
         A. a first portion; and
         B. a second, substantially transparent portion communicating with the substantially transparent part of the exterior surface for permitting viewing through the plastic film of the outer ply;
      iii. a top edge comprising:
         A. a first top edge portion; and
         B. a second top edge portion sealed to the first top edge portion;
      iv. a bottom edge comprising:
         A. a first bottom edge portion; and
         B. a second bottom edge portion sealed to the first bottom edge portion;
      v. a first side edge abutting the top and bottom edges; and
      vi. a second side edge abutting the top and bottom edge and sealed to the first side edge;
   b. an inner ply comprising a plastic film having:
      i. an exposed surface comprising:
         A. a first portion; and
         B. a second portion; and
      ii. a contacting surface comprising:
         A. a first portion laminated to the first portion of the interior surface to form the substantially unitary wall; and
         B. a second portion not laminated to the interior surface but communicating with the second portion of the exposed surface;
   c. a removable printed promotional piece positioned between but not adhered in any manner to the second portions of the contacting and interior surfaces and having a periphery surrounded by and closely adjacent to the laminated first portions of the contacting and interior surfaces, for permitting viewing of the piece through the plastic film of the outer ply and preventing movement of the piece relative to the second portions of the contacting and interior surfaces while preventing viewing of the snack food when the package is sealed;

d. means, connected to the second portion of the exposed surface, for detaching the second portions of the exposed and contacting surfaces from, respectively, the first portions of the exposed and contacting surfaces, thereby permitting removal of the printed piece from the interior of the package without delaminating the first portions of the contacting and interior surfaces; and e. a non-adhesive, silicone-based agent, applied to the piece prior to positioning between the second portions of the contacting and interior surfaces, for preventing the piece from bonding to the second portions of the contacting and interior surfaces and thereby facilitating removal of the piece from the package.

7. A package according to claim 6 in which the inner ply is of smaller size than the outer ply.

8. A package according to claim 6 in which the detaching means comprises a tab.

* * * * *

UNITED STATES PATENT AND TRADEMARK OFFICE

CERTIFICATE OF CORRECTION

PATENT NO. : 5,127,743

DATED : July 7, 1992

INVENTOR(S) : Robert F. Miller and Ronald E. Carroll

It is certified that error appears in the above-identified patent and that said Letters Patent is hereby corrected as shown below:

Column 7, line 51, delete "potion" and insert --portion--

Signed and Sealed this

Fifth Day of October, 1993

*Attest:*

*Attesting Officer*

BRUCE LEHMAN

*Commissioner of Patents and Trademarks*